US008613378B2

(12) United States Patent
Moretti

(10) Patent No.: US 8,613,378 B2
(45) Date of Patent: Dec. 24, 2013

(54) AXIALLY STATIONARY PLUG WITH ONE-WAY ROTATION

(75) Inventor: Matteo Moretti, Crema (IT)

(73) Assignee: Lumson S.p.A., Capergnanica (CR) (IT)

( * ) Notice: Subject to any disclaimer, the term of this patent is extended or adjusted under 35 U.S.C. 154(b) by 42 days.

(21) Appl. No.: 13/331,432

(22) Filed: Dec. 20, 2011

(65) Prior Publication Data

US 2012/0160882 A1 Jun. 28, 2012

(30) Foreign Application Priority Data

Dec. 22, 2010 (IT) ..... M12010A02372

(51) Int. Cl.

| | |
|---|---|
| ***B67D 3/00*** | (2006.01) |
| ***B67D 7/06*** | (2010.01) |
| ***B65D 47/00*** | (2006.01) |
| ***B65D 39/00*** | (2006.01) |
| ***B65D 41/00*** | (2006.01) |
| ***B65D 43/00*** | (2006.01) |
| ***B65D 55/16*** | (2006.01) |
| ***B65D 43/12*** | (2006.01) |
| ***B65D 43/20*** | (2006.01) |

(52) U.S. Cl.

USPC ..... 222/521; 222/503; 222/554; 215/243; 215/306; 220/345.2

(58) Field of Classification Search

USPC ..... 222/147, 153.05, 498, 499, 502, 503, 222/521, 554; 215/235–236, 243, 263, 306, 215/354; 220/345.1–345.3

See application file for complete search history.

(56) References Cited

U.S. PATENT DOCUMENTS

| | | | | |
|---|---|---|---|---|
| 4,605,135 | A | 8/1986 | Ryder | |
| 5,186,369 | A * | 2/1993 | Aguirrezabal | 222/521 |
| 5,713,493 | A * | 2/1998 | Garibaldi | 222/153.06 |
| 6,062,441 | A * | 5/2000 | Mengeu et al. | 222/521 |
| 6,065,648 | A * | 5/2000 | Tauber | 222/153.14 |
| 6,334,555 | B1 * | 1/2002 | Randall et al. | 222/521 |
| 6,450,367 | B1 * | 9/2002 | Sittler | 222/39 |
| RE39,727 | E * | 7/2007 | Sprick et al. | 222/153.14 |
| 2001/0052531 | A1 | 12/2001 | Randall et al. | |
| 2005/0040190 | A1 * | 2/2005 | Stoneberg et al. | 222/521 |
| 2007/0284331 | A1 * | 12/2007 | Miota et al. | 215/320 |

FOREIGN PATENT DOCUMENTS

| | | | | |
|---|---|---|---|---|
| EP | 0181115 | A2 | 5/1986 | |
| EP | 558273 | A1 * | 9/1993 | B65D 47/24 |

OTHER PUBLICATIONS

European Search Report dated Sep. 16, 2011 for Italian patent application No. MI 2010A002372 to Lumson SpA.

* cited by examiner

*Primary Examiner* — Paul R Durand
*Assistant Examiner* — Matthew Lembo
(74) *Attorney, Agent, or Firm* — Novak Druce Connolly Bove + Quigg LLP

(57) ABSTRACT

A device for dispensing fluid substances, preferably creams, including a container with which a cap is associated formed from an inner body seal inserted into the mouth and an outer body superposed on the inner body. The outer body presenting elements for its coupling to the container which enable it to undergo axial translation relative to the inner body, from which an elongated appendix projects presenting apertures for dispensing the product. The cap is operable between a closed position and a dispensing position. The container is provided with at least one abutment adapted to oppose a counter-abutment provided on the inner body to prevent the inner body from rotating relative to the container to define the dispensing position.

13 Claims, 3 Drawing Sheets

AXIALLY STATIONARY PLUG WITH ONE-WAY ROTATION

CROSS-REFERENCE TO RELATED APPLICATIONS

This application claims priority under 35 USC 119 from Italian Application No. MI2010A 002372, filed Dec. 22, 2010.

BACKGROUND OF THE INVENTION

The present invention relates to a device comprising a dispensing cap applicable to the mouth of a container of liquid or creamy substances and operable by simple rotation to close the container mouth and respectively to open it to enable said substances to be dispensed.

Various types of caps are known applicable to a container mouth to close or open passage through said mouth by merely rotating in one direction or another the most outer component forming part of the cap.

U.S. Pat. No. 4,383,623 and U.S. Pat. No. 5,810,185 describe dispensing caps formed from only two constituent parts, one superposed on and external to the other, which engage one on the other via mutually cooperating helical ribs projecting from the facing cylindrical surfaces of the two parts.

U.S. Pat. No. 3,010,619, U.S. Pat. No. 4,690,304 and U.S. Pat. No. 6,244,476 describe dispensing caps also formed from only two parts, of which the inner part is applied and retained by friction on the container mouth, while the cap outer part has a thread which engages a thread provided on the outer surface of the container mouth.

All the aforementioned dispensing caps comprise an outer component substantially in the form of a cylindrical wall with a dome at its top, in the centre of which a hole is provided through which the free end of an elongated appendix is inserted forming part of the inner cap component, to sealedly close this hole and hence prevent dispensing of the fluid substance contained in the container on which the cap is applied. The dispensing hole is opened when the cap outer component is rotated in the unscrewing direction relative to the inner component, the liquid substance then being able to be freely withdrawn from the container.

Means are provided between the cap inner component and the outer component to limit the rotation of the second relative to the first, these acting essentially as a limit stop.

Given that the cap inner component is fixed on the container mouth simply by friction, when the outer component is completely unscrewed (i.e. until it reaches the limit stop) a part of the residual torque is transmitted to the cap inner component, which can undergo stress or slight rotation about the container mouth.

This slight rotation means that the user is unable to precisely determine when the limit stop, and hence complete container opening, have been attained.

The stress subsequently transmitted to the inner body, and resulting in movement of the inner body relative to the mouth, can compromise the seal means present between these latter, hence causing undesired product leakage.

BRIEF SUMMARY OF THE INVENTION

The main object of the present invention is to produce a dispensing device provided with a cap made with only two pieces, which overcomes the technical drawbacks of the known art.

A further object of the present invention is to provide a device presenting a precise and stable limit stop mechanism, and which prevents possible product leakage even after considerable cap usage.

To enable a better understanding of the structure and characteristics of the dispensing device of the present invention, one embodiment thereof is described hereinafter by way of non-limiting example with reference to the accompanying drawings, in which:

DETAILED DESCRIPTION OF THE INVENTION

Figure 1:
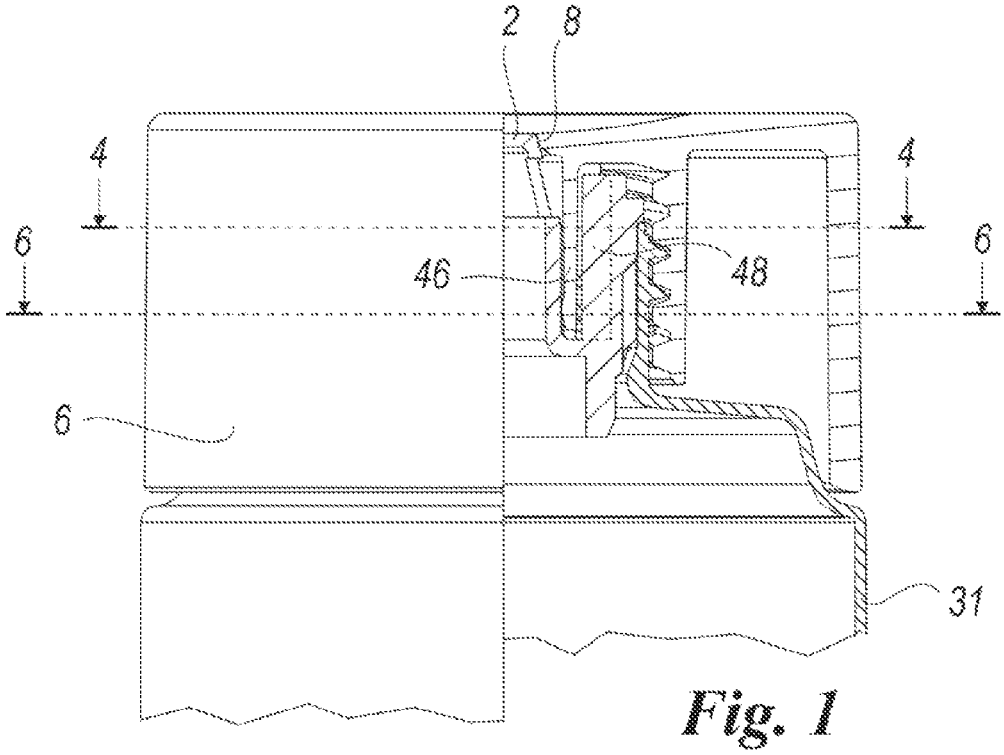
FIGS. 1 and 2 are a section and part section through a dispensing device shown respectively in the closed and open or dispensing position.
Figure 2:
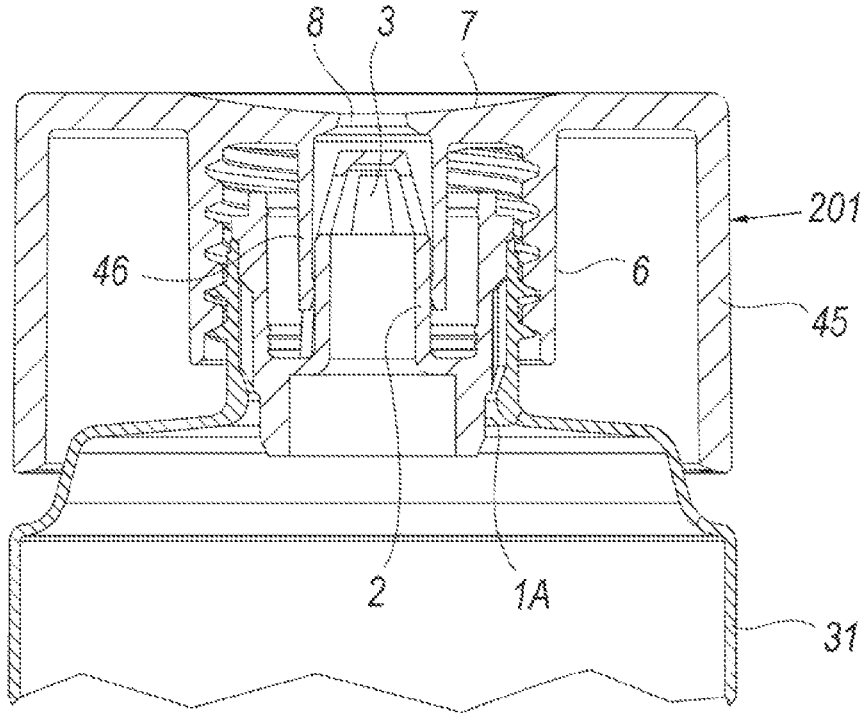
Figure 3:
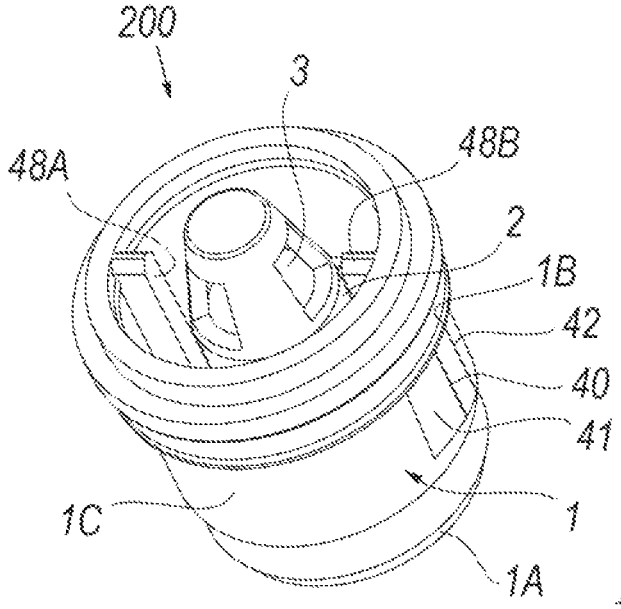
FIG. 3 is a perspective view of an inner body of the device of FIG. 1.

Reference will firstly be made to FIGS. 1 and 2, schematically showing in axial section a container and dispensing cap formed from only two component parts, i.e. an inner body, and an outer body superposed thereon.

The inner body 200 is formed in a single piece and comprises a tubular skirt 1 sealedly insertable into the cavity 30 of the mouth of a container 31 of a fluid substance (liquid or cream) to be dispensed and an axially extending elongated appendix 2 in which windows or apertures 3 are provided. On its outer surface the tubular skirt 1 presents a nozzle portion 1A and a substantially tubular portion 1B to cooperate by interference with the inner surface of the mouth 30. The tubular portion 1B is also provided with a seal bead of conventional type and is upperly bounded by a flange which comes to rest on the free edge of the mouth of the container 31.

The outer body 201 is formed in a single piece and comprises a cylindrical lateral wall 6 and a top wall 7; a projecting thread (not numbered for simplicity but clearly visible in the drawings) is provided on the lateral wall 6, to be screwed onto a thread projecting from the outer surface of the container mouth 30 on which the cap has been mounted. Screwing or unscrewing the outer body causes its axial movement.

In the top wall 7 a discharge hole 8 is provided coaxial with the appendix 2, the free end of which can be inserted into said hole to seal it when the cap is closed (FIG. 1).

Figure 4:
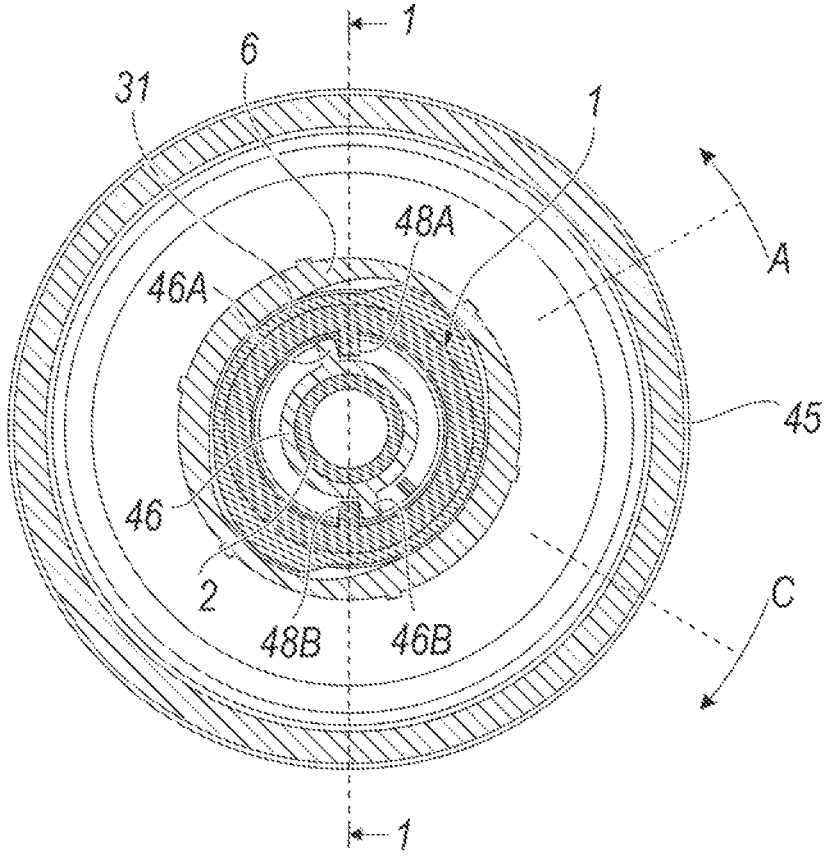
FIG. 4 is a cross-section taken on the line 4-4 of FIG. 1.
Figure 5:
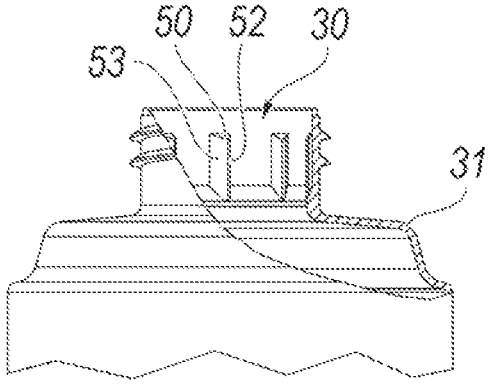
FIG. 5 shows a container partially sectioned at its mouth, and part of the device of the present invention.

About the discharge hole 8 a tubular projection 46 is provided integral with the outer body 201 and sealedly mounted slidingly on the appendix 2 of the inner body 200. A pair of lugs (projections 46A, 46B) extend from the tubular element 46 of the outer body 201 and by making contact with stops 48A, 48B provided rigid with the inner body limit the rotation of the outer body relative to the inner body. The projections 46A, 46B and stops 48A, 48B are provided in an annular groove provided on the outside of the appendix 2 of the inner body 200 and laterally bounded by the tubular skirt 1 of the inner body 200 as shown in FIG. 4.

Two stops and two projections are preferably provided to form a limit stop for opening purposes, however a single stop/projection pair is sufficient.

A skirt 45 substantially having the same diameter as the container 31 with which the cap is associated extends from the top wall to act as a grip.

According to the present invention, between the nozzle portion 1A and the tubular surface 1B of the inner body 200 an intermediate surface 1C is present from which teeth 40 (counter-abutments) project presenting a profile provided with a lead-in surface 41 and a stepped surface 42 which extends radially outwards from the inner body. The counter-abutments 40 are preferably two in number, disposed diametrically.

To cooperate with them when the inner body is inserted into it, the inner surface of the mouth 30 presents further teeth acting substantially as abutments 50 for the counter-abutments 40 present on the inner body. The abutments 50 also have a profile provided with a lead-in 53 and a stepped surface 52 which extends radially outwards from the inner body. By mutually cooperating, the stepped surfaces prevent rotation of the inner body when the outer body is rotated to attain the dispensing cap open position, while enabling its rotation in the reverse direction.

The operation of the invention is apparent to an expert of the art and is essentially as follows.

It will be assumed that the cap is to be opened starting from the position shown in FIG. 1 in which the projections 46A and 46B are in contact with the stops 48 and 48B respectively. The outer body 201 is firstly rotated in the direction of the arrow A of FIG. 4. The rotation of the outer body causes it to rise by the action of the threaded coupling present on the mouth 30. The top of the appendix 2 emerges from the dispensing hole 8, hence opening the container and connecting the container interior, via the windows 3, to the external environment into which the product can be dispensed.

The rotation proceeds for about 165° until the projections 46B and 46A halt against the stop 48A and the stop 48B respectively.

Figure 6:
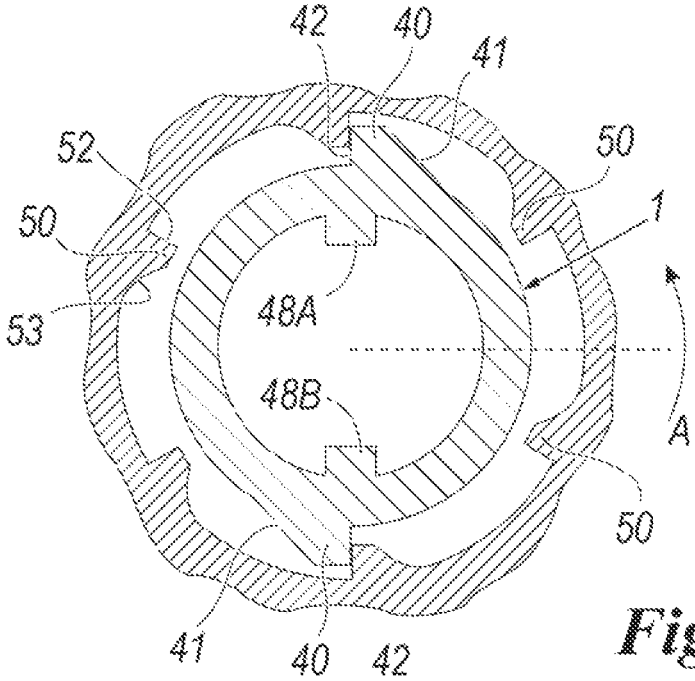
FIG. 6 is a section through just the inner body and the container taken on the line 6-6 of FIG. 1.

In this condition a further torque is transmitted by the outer body to the inner body precisely via the contacting stops/projections in the direction of the arrow A, this torque (see FIG. 6) being further discharged by the stepped surface 42 of the counter-abutments 40 onto the stepped surface 52 of the abutments 50, and from these to the container.

Any further rotation of the outer element is hence prevented in the direction of opening, which is hence secure and well defined.

Container closure is achieved by rotating the outer element in the direction of the arrow C until the position shown in FIGS. 1 and 4 is again achieved.

It should be noted that in this condition, clockwise rotation of the inner element relative to the mouth of the container 31 is permitted by the particular shape of the teeth/abutments and of the mutual bevelled lead-in surfaces 41/53.

This facility for closure-rotating the inner element 1 is very important for correctly mounting the outer element on the mouth of this latter, which otherwise would not be possible.

The provision of one abutment on the container able to oppose a counter abutment provided on the inner body is very important. In the prior art it was necessary to give an interference between the inner body and the mouth of the container in order to prevent the rotation of the inner body. This interference was provided on a cylindrical portion that had almost the same height as the part of the inner element inserted in the mouth.

By providing anti-rotation means according to the present invention, it is possible to design the inner body in order to have a smaller surface making interference with the mouth, the minimal necessary surface to grant seal.

This results in an easier mounting of the cap in the mount, compared with the prior art.

In fact, in the prior art great pressure was needed to fit the inner element in the mouth to win the force exerted by the large portion of the inner element mounted with interference in the mouth of the countainer.

According to the present invention, the interference is present only on a cylindrical surface of very small height (only necessary for sealing) and this results in a smaller force being needed to insert the inner element inside the mouth.

Furthermore, according to the new invention, it is possible to realize the container and inner element with different plastic material, i.e., PP, PETG and also with PE or LDPE, which are softer materials.

In the prior art, the use of a softer material would have brought to a remarkable increase in the force necessary to mount the inner body in the mouth. In addition to the illustrated embodiment, other embodiments based on the same inventive concept are possible.

For example, the abutments/counter-abutments could be provided on the top of the mouth and on the lower side of the flange of the inner body.

The invention claimed is:

1. A device for dispensing fluid substances, comprising a container with which a cap is associated, the cap formed from an inner body sealedly inserted into a mouth of the container and from an outer body superposed on the inner body and bounded upwardly by a top wall, the outer body presenting means for coupling the outer body to the container which enable the outer body to undergo sealed axial translation relative to the inner body, from the inner body an axially hollow elongated appendix projects presenting apertures for dispensing the product, the appendix extending axially towards a discharge hole provided in the top wall of the outer body, the cap being operable between a closed position in which said discharge hole is sealedly closed by a free end of said appendix and a dispensing position in which said discharge hole is disengaged from the free end of said appendix, the outer body being provided with at least one projection adapted to encounter at least one stop provided on the inner body when the outer body lies in said dispensing position, at least one abutment adapted to oppose a counter-abutment provided on the inner body to prevent this inner body from rotating relative to the container to define said dispensing position, wherein said abutment is provided on an inner surface of the container mouth, and wherein said abutment and counter-abutment are configured to define a first direction in which rotation of the inner body is enabled and a second direction, opposite the first direction, in which said rotation is not enabled.

2. A device as claimed in claim 1, wherein said abutment presents a profile provided with a lead-in surface and with a stepped surface which extends radially towards the centre of the mouth, said counter-abutment presenting a lead-in surface and a stepped surface which extends radially outwards from the inner body.

3. A device as claimed in claim 1, wherein the inner body is formed in one piece and presents a sealing bead which engages the inner surface of the mouth in a portion in which said abutment is absent.

4. A device as claimed in claim 1, wherein the mouth presents a plurality of said abutments, said inner body presenting two said counter-abutments.

5. A device as claimed in claim 1, wherein a cylindrical wall projects from the top wall of the outer body to be sealedly mounted about said appendix.

6. A device as claimed in claim 5, wherein the outer body projection is external to the cylindrical wall, the inner body stop being provided in an annular groove provided on the outside of the appendix.

7. A device as claimed in claim 5, wherein about the discharge hole the cylindrical wall is provided, wherein the cylindrical wall is integral with the outer body and projects downwardly from the top wall to be sealedly mounted slidingly on said appendix, wherein the at least one projection extends radially outwardly from the cylindrical wall and at least one stop extends radially inwardly from the inner body for limiting rotation of the outer body relative to the inner body by contact with said at least one projection, wherein the outer body projection is external to the cylindrical wall, wherein the inner body stop and outer body projection are in an annular groove provided on the outside of the appendix of the inner body and laterally bounded by a tubular skirt of the inner body.

8. A device as claimed in claim 7, wherein the inner surface of the container mouth presents said abutments, an outer surface of said inner body presenting said counter-abutments, wherein each abutment provides a sloping tooth having a sloped lead in surface and a stepped surface, wherein each counter abutment provides a sloping tooth having a sloped lead in surface and a stepped surface, the abutment and counter abutment configured for the sloped lead in surface of the abutment to contact the sloped lead in surface of the counter abutment to permit rotation in one direction and the stepped surface of the abutment to contact the stepped surface of the counter abutment to stop rotation in a direction opposite to said one direction, whereby the abutment engages the counter abutment to permit rotation in only said one direction.

9. A device as claimed in claim 5, wherein the outer body projection is external to the cylindrical wall, the outer body projection being provided in an annular groove provided on the outside of the appendix.

10. A device as claimed in claim 1, wherein the coupling means between the outer body and the container comprise a thread provided on the outside of the mouth.

11. A device as claimed in claim 1, wherein the device is for dispensing said fluid substances in the form of a cream.

12. A device as claimed in claim 1, wherein the mouth presents six abutments, said inner body presenting two counter-abutments.

13. A device as claimed in claim 1, wherein the inner surface of the container mouth presents said abutments, an outer surface of said inner body presenting said counter-abutments, wherein each abutment provides a sloping tooth having a sloped lead in surface and a stepped surface, wherein each counter abutment provides a sloping tooth having a sloped lead in surface and a stepped surface, the abutment and counter abutment configured for the sloped lead in surface of the abutment to contact the sloped lead in surface of the counter abutment to permit rotation in one direction and the stepped surface of the abutment to contact the stepped surface of the counter abutment to stop rotation in a direction opposite to said one direction, whereby the abutment engages the counter abutment to permit rotation in only said one direction.

* * * * *